US007222839B2

(12) United States Patent
Taylor et al.

(10) Patent No.: US 7,222,839 B2
(45) Date of Patent: May 29, 2007

(54) CABLE SLACK AND GUIDE MONITORING APPARATUS AND METHOD FOR A LIFT DEVICE

(75) Inventors: Michael K. Taylor, Marion, NY (US); Mark F. Scholand, Spencerport, NY (US)

(73) Assignee: Gorbel, Inc., Fishers, NY (US)

( * ) Notice: Subject to any disclaimer, the term of this patent is extended or adjusted under 35 U.S.C. 154(b) by 175 days.

(21) Appl. No.: 10/777,920

(22) Filed: Feb. 12, 2004

(65) Prior Publication Data

US 2005/0179020 A1 Aug. 18, 2005

(51) Int. Cl.
*B66D 1/48* (2006.01)

(52) U.S. Cl. ..... 254/270; 242/563

(58) Field of Classification Search ..... 254/266, 254/267, 270, 271, 273, 334; 242/223, 413, 242/534, 563, 912
See application file for complete search history.

(56) References Cited

U.S. PATENT DOCUMENTS

| | | | | |
|---|---|---|---|---|
| 2,636,953 | A | 4/1953 | Hunt | |
| 4,103,562 | A * | 8/1978 | Boser | 74/567 |
| 4,915,357 | A * | 4/1990 | Valentinsen | 254/266 |
| 4,917,360 | A | 4/1990 | Kojima | |
| 5,345,691 | A * | 9/1994 | Falk et al. | 33/707 |
| 5,370,237 | A * | 12/1994 | Anderson et al. | 209/556 |
| 5,427,327 | A * | 6/1995 | Anderson et al. | 242/362 |
| 5,465,478 | A * | 11/1995 | Anderson et al. | 29/748 |
| 5,724,085 | A * | 3/1998 | Inui et al. | 347/175 |
| 5,865,426 | A * | 2/1999 | Kazerooni | 254/270 |
| 5,915,673 | A * | 6/1999 | Kazerooni | 254/270 |
| 5,960,849 | A | 10/1999 | Delaney | |
| 6,126,103 | A * | 10/2000 | Nanbu | 242/223 |
| 6,299,139 | B1 * | 10/2001 | Kazerooni | 254/270 |
| 6,386,513 | B1 * | 5/2002 | Kazerooni | 254/270 |
| 6,439,544 | B1 * | 8/2002 | Rosenberg | 254/334 |
| 6,547,220 | B2 * | 4/2003 | Johnson | 254/331 |
| 6,554,252 | B2 * | 4/2003 | Kazerooni et al. | 254/270 |
| 6,595,493 | B2 * | 7/2003 | Krebs et al. | 254/266 |
| 6,622,990 | B2 * | 9/2003 | Kazerooni | 254/270 |
| 6,634,621 | B2 * | 10/2003 | Keith | 254/270 |
| 6,886,812 | B2 * | 5/2005 | Kazerooni | 254/270 |
| 6,916,015 | B2 * | 7/2005 | Andreasson | 254/270 |

* cited by examiner

*Primary Examiner*—Emmanuel M Marcelo
(74) *Attorney, Agent, or Firm*—Duane C. Basch; Basch & Nickerson LLP

(57) ABSTRACT

The present invention is a method and apparatus for monitoring the condition of a cable in a human power amplifying lift system. The method and apparatus employ a cable slack sensor and a cable end sensor to override and prevent the lift from continuing to unwind the lift cable when slack or and end of travel limit has been reached.

15 Claims, 5 Drawing Sheets

CABLE SLACK AND GUIDE MONITORING APPARATUS AND METHOD FOR A LIFT DEVICE

This invention relates generally to an intelligent material handling devices that lift and lower loads as a function of operator-applied force, and more particularly to an apparatus and method to improve the safety and performance for such devices by monitoring the cable tension and cable winding on a lift pulley so as to prevent slack in the cable.

BACKGROUND AND SUMMARY OF THE INVENTION

The present invention is directed to intelligent material handling devices that lift and lower loads as a function of operator-applied force. The devices described herein are different from manual material handling devices currently used by assembly and warehouse workers in that the devices respond to the operator's interaction with the lifting device, and not merely to an operator's pushing, depressing or squeezing of a switch or button on a control pendant.

More specifically, the present invention is directed to a class of material handling devices called balancers or lifts, which include a motorized lift pulley having a cable or line that wraps around the pulley as the pulley is rotated, and an end-effector that is attached to the end of the cable. The end-effector has components that connect to the load being lifted. The pulley's rotation winds or unwinds the line and causes the end-effector to lift or lower the load connected to it. In this class of material handling systems, an actuator generates an upward line force that exactly equals the gravity force of the object being lifted so that the tension in the line balances the object's weight. Therefore, the only force the operator must impose to maneuver the object is the object's acceleration force.

There are two ways of creating a force in the line so that it exactly equals or balances the object weight. First, when the system is pneumatically powered, the air pressure is adjusted so that the lift force equals the load weight. Second, when the system is electrically powered, the right amount of voltage is provided to an amplifier associated with the pulley drive motor to generate a lift force that equals the load weight. The fixed preset forces of balancers are not easily changed in real time, and therefore these types of systems are not suited for maneuvering of objects of various weights.

Another class of material handling device use end-effectors equipped with force sensors or motion sensors. These devices measure the human force or motion and, based on this measurement, vary the speed or force applied by the actuator (pneumatic drive or electric drive). An example of such a device is U.S. Pat. No. 4,917,360 to Yasuhiro Kojima, U.S. Pat. No. 6,622,990 to Kazerooni, and U.S. Pat. No. 6,386,513 to Kazerooni. U.S. Pat. No. 6,622,990 for a "HUMAN POWER AMPLIFIER FOR LIFTING LOAD WITH SLACK PREVENTION APPARATUS," to Kazerooni., issued Sept. 23, 2003, is hereby incorporated by reference in its entirety. With this and with similar devices, when the human pushes upward on the end-effector the pulley turns and lifts the load; and when the human pushes downward on the end-effector, the pulley turns in the opposite direction and lowers the load.

A problem may occur when the operator presses downward on the end-effector to engage the load with a gripping mechanism such as suction cups; the controller and actuator interpret this motion as an attempt to lower the load. Also, during fast maneuvers workers can accidentally hit the loads they intend to lift or their surrounding environment (e.g. conveyor belts) with the bottom of the end-effector. In palletizing tasks, for example, workers often use the bottom of the end-effector to fine tune the location of a box or container. These occurrences may cause slack in the line since the operator might push downward on the end-effector handle to locate box, while the end-effector is constrained from moving downward. As a result, the actuator causes the pulley to release more line than necessary, thereby creating "slack" in the cable. As used herein, the term "slack" is understood to mean an excessive length of cable or line, and may or may not include instances where the line is simply not completely taut.

Once slack is produced in the line, by this or other circumstances, when the operator pushes upward on the handle, the slack line can become entangled around the operator's neck, arms or hands, or interfere with other equipment, creating the possibility for injury or damage. A slack cable is also a problem for the overall mechanics of the lift. If the lifting cable is stiff enough and slack is created in the cable, then it pushes the cable off the lift pulley that is used to wind and unwind the load cable. When tension is reintroduced into the load cable, not all of the slack comes out of the cable wrapped around the lift pulley. Repeated occurrences of slack will eventually cause the cable to come off the drum or become entangled in other components or hardware in the actuator. Covers that go over the drum are not sufficient to prevent the cable from eventually becoming entangled in the mechanics of the actuator. Slack can occur even when other end effectors are used for load gripping means. Therefore, to assure safe operation it is important to prevent slack at all times. In general, slack in the line can be dangerous for the operator and others in the same work environment.

Heretofore, a number of patents and publications have disclosed apparatus and methods for controlling slack in lift cables, the relevant portions of which may be briefly summarized as follows:

U.S. Pat. No. 6,622,990 to Kazerooni, discloses a controller for a pulley hoist arrangement, wherein the controller stops the pulley when a signal represents zero tensile force on the lift line but the end-effector is pushed downwardly by the operator. The patent is a division of allowed parent application Ser. No. 09/443,278, filed Nov. 18, 1999, now U.S. Pat. No. 6,386,513 by Homayoon Kazerooni, entitled "Human Power Amplifier For Lifting Load Including Apparatus For Preventing Slack In Lifting Cable" which parent application claims the benefit of U.S. Provisional Application Nos. 60/134,002, filed on May 13, 1999, Application No. 60/146,538, filed on Jul. 30, 1999, and Application No. 60/146,541, filed on Jul. 30, 1999. Both the parent and provisional applications are also hereby incorporated by reference in their entirety for their teachings.

U.S. Pat. No. 5,960,849 to Delaney et al., issued Oct. 5, 1999, teaches an apparatus for detecting the occurrence of slack in a cable as well as compensation for cable slack in a door operator.

U.S. Pat. No. 2,636,953 to Hunt, issued April 28, 1953, discloses an electric safety switch for a load carrying device, to automatically stop downward motion when cable tension falls below a predetermined minimum.

As briefly described above, during the operation of an intelligent lift, such as the G-force lift manufactured and sold by Gorbel, Inc., an operator may move the control handle in such a way as to place the lift, and its associated load, into a condition where the lift cable experiences some slack between the actuator and the handle/load. While the G-force Lift is programmed to reduce the likelihood of such a situation (see e.g., U.S. Pat. No. 6,622,990, previously incorporated by reference), one aspect of the present invention is directed at the failsafe detection of cable slack. Another aspect of the invention is directed at monitoring of the number of winds of cable left on the lift pulley of the actuator, so as to assure that, at a minimum, approximately two winds (revolutions) of line or cable are wrapped about the lift pulley. In combination, these aspects are safety features directed at preventing the unwind of the cable from a lift pulley, thereby preventing the possible jerking of a load, the potential malfunction of the lift, and the various safety concerns set forth above.

In accordance with the present invention, there is provided a human power amplifier assist device, including: a lift pulley with a cable wound thereon; an actuator arranged to turn the lift pulley so as to wind and unwind the cable; an end-effector connected to the cable and connectable to a load, the end-effector including a sensor for detecting an operator-applied force on the end effector; a controller for controlling operation of the actuator, the controller being responsive to a first signal from the sensor representing operator-applied force and at least one additional signal representing the condition of the cable; and the controller being programmed to cause the actuator to wind and unwind the cable in response to the first signal, and to override the control as a function of the first signal in response to the additional signal.

In accordance with another aspect of the present invention, there is provided a device for monitoring the condition of a cable wound on a lift pulley, and generating at least one signal indicative of the condition, including: a cable slack sensor; and a cable end sensor; wherein the at least one signal representing the condition of the cable includes a cable slack signal generated by the cable slack sensor and a cable end signal generated by the cable end sensor.

In accordance with yet another aspect of the present invention, there is provided a method for monitoring the condition of a cable wound on a lift pulley, including: monitoring the slack condition of a cable with a slack sensor; and monitoring the length of cable, with a cable end sensor, to determine when a predetermined maximum length of cable has been unwound.

One aspect of the invention is based on the discovery that further failsafe manual sensors may be employed to assure that abnormal use or abuse situations do no result in a slack cable condition on a lift device. This discovery avoids problems that arise in lift systems, including intelligent lifts, whereby sensing of the operator's applied force may result a slack cable condition.

This aspect is further based on the discovery of techniques that can be used during normal operation of such lifts, whereby conventional mechanical sensors or switches may be employed to detect and minimize or prevent slack cable conditions. This aspect of the invention can be implemented, for example, by separate or a combination of sensors for the detection of cable slack and tracking of cable winding on a lift pulley.

The technique described herein is advantageous because it is simple and can be adapted to any of a number of lift devices employing a cable and lift pulley on which the lift cable or line is wound. In addition, it can be used to in the automated control and customized setup of a lift to facilitate improved performance. As a result of the invention, the performance and safety of intelligent lifting devices is improved. One of the most important properties of the invention is that the actuator and pulley operate under the control of the operator on the end-effector so as to follow the operator's hand motion upwardly and downwardly—yet the line does not become slack if the end-effector is physically constrained from moving downwardly while the end-effector is pushed downwardly by the operator.

Figure 1:
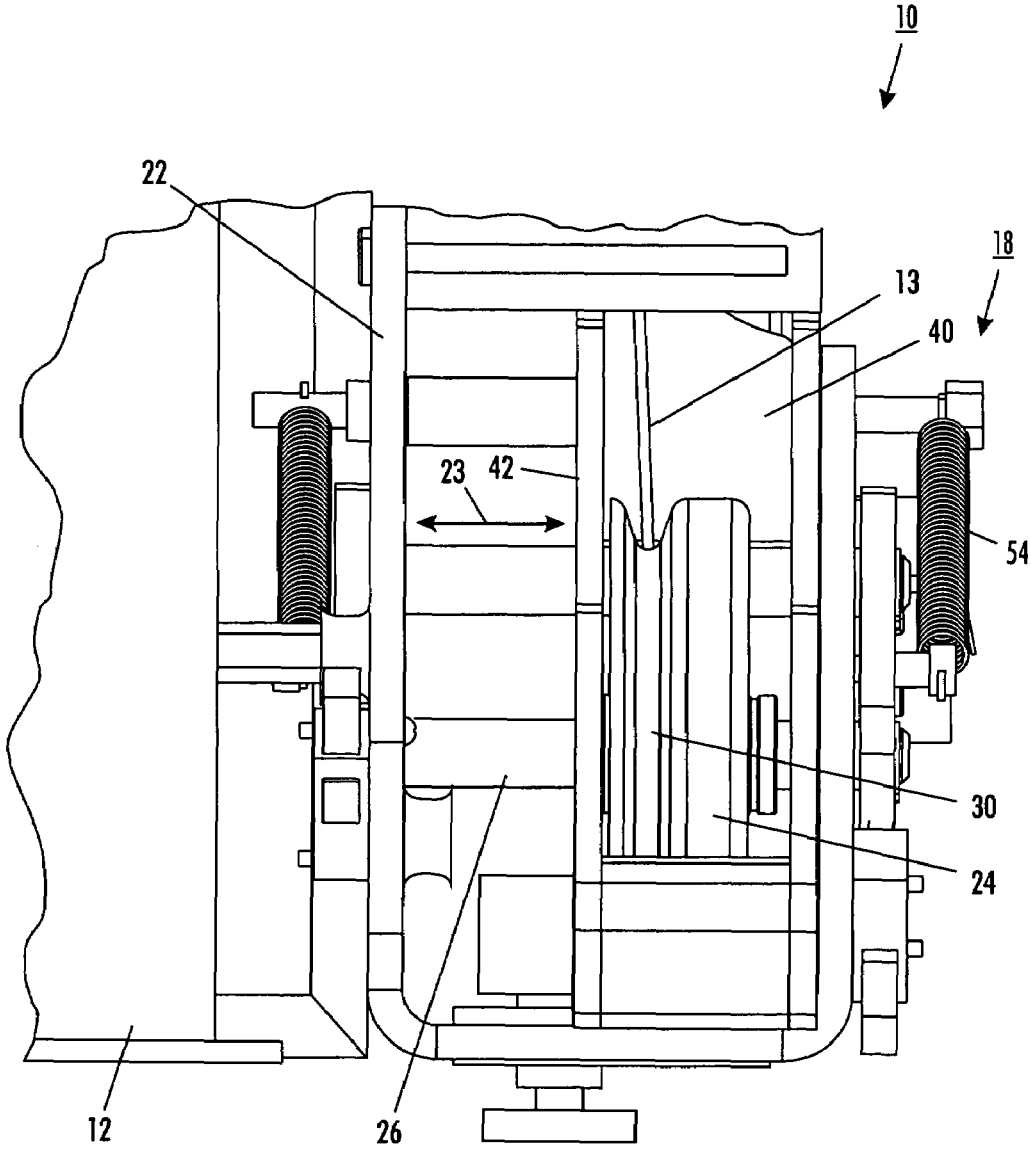
FIGS. 1 and 3 are orthographic views of an exemplary lift device in accordance with an aspect of the present invention.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENT

For a general understanding of the present invention, reference is made to the drawings. In the drawings, like reference numerals have been used throughout to designate identical elements.

Figure 2:
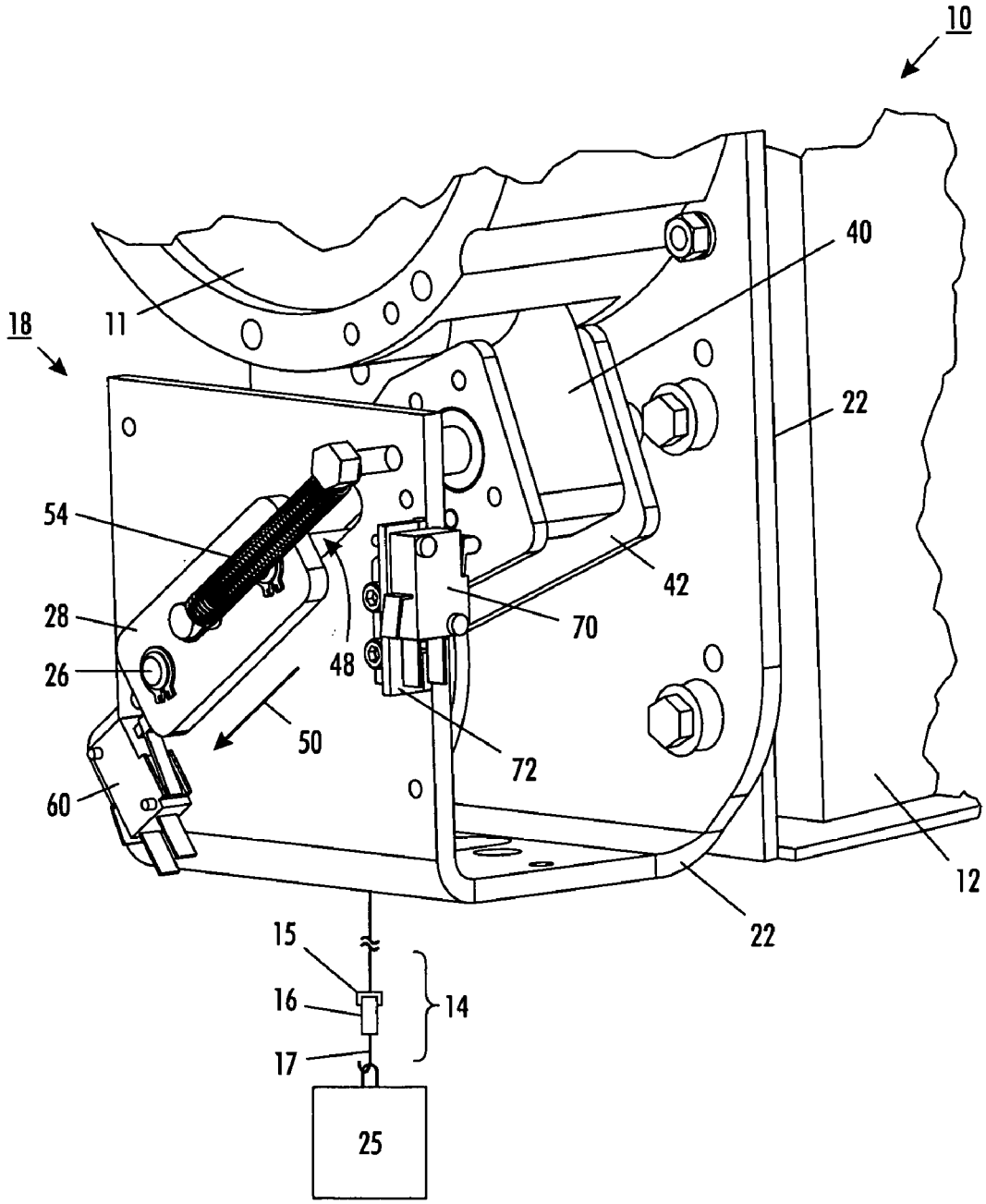
FIG. 2 is a perspective view of the device of FIG. 1 and further including an associated load and end-effector.

Referring to FIGS. 1 and 2, there is depicted an embodiment of the invention, showing a take-up or drive pulley and associated mechanical assemblies in an exemplary human power amplifier 10. At the top of the device, a take-up pulley 11, driven by an actuator 12, is attached directly to a ceiling, wall, or overhead crane (not shown). Encircling pulley 11 is a line 13. Line 13 is capable of lifting or lowering a load 25 when the pulley 11 turns. Line 13 can be any type of line, wire, cable, belt, rope, wire line, cord, twine, string or other member that can be wound around a pulley and can provide a lifting force to a load. Attached to line 13 is an end-effector 14, that includes a human interface subsystem 15 (including a handle 16) and a load interface subsystem 17, which in this embodiment includes a J-hook, but may also include a pair of suction cups or similar load grasping means. Not shown, but included in a suction cup embodiment, would be an air hose for supplying the suction cups with low-pressure air.

In the preferred embodiment, actuator 12 is an electric motor with a transmission, but alternatively it can be an electrically-powered motor without a transmission. Furthermore, actuator 12 can also be powered using other types of power including pneumatic, hydraulic, and other alternatives. As used herein, transmissions are mechanical devices such as gears, pulleys and lines that increase or decrease the tensile force in the line. Pulley 11 can be replaced by a drum or a winch or any mechanism that can convert the rotational or angular motion provided by actuator 12 to vertical motion that raises and lowers line 13. Although in this embodiment actuator 12 directly powers the take-up pulley 11, one can mount actuator 12 at another location and transfer power to the take-up pulley 11 via another transmission system such as an assembly of chains and sprockets. Actuator 12 is preferably driven by an electronic controller (FIG. 4, 100) that receives signals from end-effector 14 over a signal cable (not shown) or similar signal transmission means. It will be appreciated that there are several ways to transmit electrical signals, such that the transmission means can be an alternative signal transmitting means including wireless transmission (e.g., RF, optical, etc.). In a preferred embodiment the controller 100 of FIG. 4 contains three primary components:

1. Control circuitry including an analog circuit, a digital circuit, and/or a computer with input output capability and standard peripherals. The function of the control circuitry is to process the information received from various input sensors and switches and to generate command signals for control of the actuator (via the power amplifier).
2. A power amplifier that sends power to the actuator in response to a command from the control circuitry. In general, the power amplifier receives electric power from a power supply and delivers the proper amount of power to the actuator. The amount of electric power supplied by the power amplifier to actuator 12 is determined by the command signal generated within the computer and/or control circuitry. It will be appreciated that various motor-driver-amplifier configurations may be employed, based upon the requirements of the lift.
3. A logic circuit composed of electromechanical or solid state relays, to start and stop the system in response to a sequence of possible events.

For example, the relays are used to start and stop the entire system operation using two push buttons installed either on the controller or on the end-effector. The relays also engage the friction brake in the presence of power failure or when the operator leaves the system. In general, depending on the application, various architectures and detailed designs are possible for the logic circuit. In one embodiment, the logic circuit may be similar to that employed in the G-force lift manufactured and sold by Gorbel, Inc.

As described in detail in U.S. Pat. No. 6,622,990, previously incorporated by reference, human interface subsystem 15 is designed to be gripped by a human hand and measures the human-applied force, i.e., the force applied by the human operator against human interface subsystem 15. In one embodiment, the human-applied force is detected by a load cell or similar output-generating sensor wherein the signal output level generated by the sensor is a function of the load applied to the end-effector by the human.

Load interface subsystem 17 is designed to interface with a load and contains various holding devices. The design of the load interface subsystem depends on the geometry of the load and other factors related to the lifting operation. In addition to the hook 17, other load interfaces could include suction cups as well as various hooks, clamps and grippers and similar means that connect to load interface subsystems. For lifting heavy objects, the load interface subsystem may comprise multiple load interfaces (i.e., multiple hooks, clamps, grippers, suction cups, and/or combinations thereof).

Figure 4:
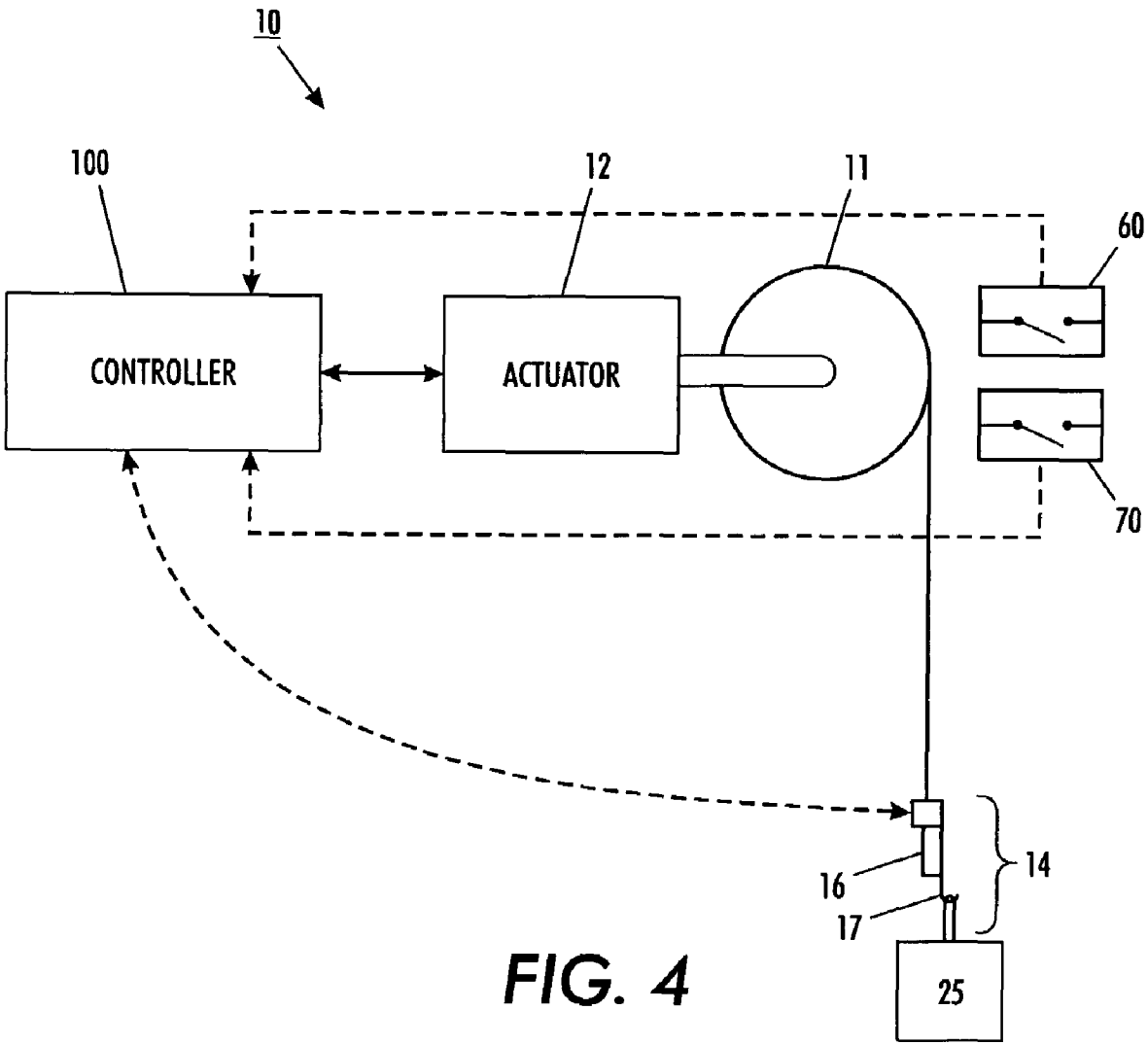
FIG. 4 is a general schematic illustration of the connections between various control and sensing components of an embodiment of the present invention.

Referring also to FIG. 4, the human interface subsystem responds to force exerted by the human operator. When the operator's hand pushes upward on the handle 16, a signal is sent to the controller and the take-up pulley 11 moves the end-effector 14 upward. When the operator's hand pushes downward on the handle 16, a signal is generated and the take-up pulley moves the end-effector 14 downward. The measurements of the forces from the operator's hand are transmitted to the controller. Furthermore, while a preferred embodiment may include a force sensor positioned in proximity to the end-effector 14, other operator-applied force measurement or estimating elements (including remote sensors at the pulley and/or actuator) can be used to estimate operator-applied forces.

In response to the force signals, the controller determines the necessary pulley force to raise or lower line 13 to create enough mechanical force to assist the operator in the lifting task as required. Controller 100 then powers actuator 12, via a power connection, to cause pulley 11 to rotate. All of this happens so quickly that the operator's lifting efforts and the device's lifting efforts are, for all purposes, synchronized. The operator's physical movements are thus translated into a physical assist from the machine, and the machine's force advantage is directly and simultaneously controlled by the human operator. In summary, the load moves vertically because of the vertical movements of both the operator and the pulley.

As explained above, other types of operator-input estimating elements can be used in place of the specific embodiments described above. Examples of alternative operator-input estimating elements may include sensors that evaluate energy consumed by the actuator during lifting or sensors that are not in proximity to the end-effector that can estimate load force or tensile force to estimate operator-applied force.

Referring again to the figures, FIG. 1 illustrates the actuator 12 and cable pulley system 18 of a G-Force lift 10. Cable pulley system 18 includes a lift pulley 11, an associated cable guide bracket 22, and a cable guide pulley 24. In operation, the lift cable 13 is wound about the lift pulley 11 and passes through an aperture (not shown) in the bottom of the bracket, where it is connected to a G-Force handle 14 for lifting a load 25 as illustrated in FIGS. 2 and 4. Between the lift pulley and the aperture, the cable also passes over cable guide pulley 24, which serves to guide the cable as it is wound and unwound from the lift pulley. Thus, in response to signals from the G-Force handle, the actuator rotates the lift pulley 20 to wind or unwind the cable and cause the handle and load to raise or lower.

In order to maximize the life of the cable, and avoid cable overlap on the lift pulley (which may result in unintended jerking of the cable as a load is lowered), the cable guide pulley 24 is preferably moved back and forth in a direction represented by arrow 23, parallel with the lift pulley axis, thereby assuring that the cable being wound on the lift pulley is located within a groove 30 on the lift pulley. In other words, the lift pulley has a continuous groove around the periphery thereof into which a single thickness of the cable is wound. The lift pulley preferably includes a groove-follower 40 that is connected to the guide pulley 24 via a bracket 42, where the groove follower 40 causes the cable guide pulley to move back and forth as the lift pulley is rotated in one direction and then the other. The groove-follower rides in the groove for the cable coil being wound or unwound currently, thereby resulting in the cable being wound/unwound at a position of the groove that is the same as that in which the groove-follower is located, thus preventing the groove-follower from interfering with the cable as it is repeatedly wound and unwound.

Figure 3:
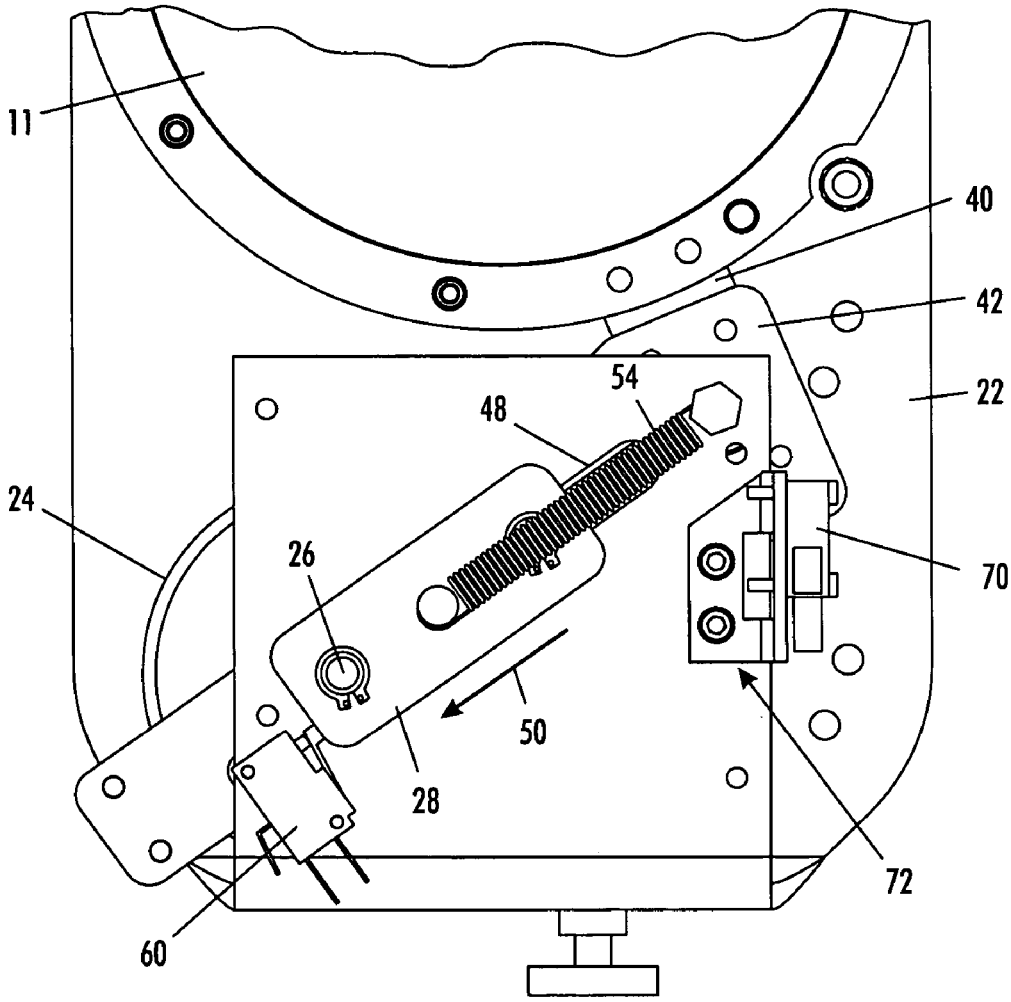

Having described the basic operation of the lift 10 and the associated intelligent lift controls, attention is now turned to the implementation of aspects of the present invention. Referring to FIGS. 1-3, the axel 26 of the guide pulley is preferably located in a slot 48 or other constrained channel, whereby the pulley generally tends to be located in a position toward the lower end of the slot 48—as indicated by the direction of arrow 50. This tendency is caused both by the orientation of slot 48 and by the force of a taught cable passing over the surface of the cable guide. However, counteracting this tendency is a biasing means in the form of one or more expansion springs 54 (only one shown), that are positioned and operatively associated with the pulley so as to cause the guide pulley to be biased or pulled away from the lower end of slot 48 whenever the cable is slack. In other words, the guide pulley is spring-biased toward the upper end of the slot 48 unless the cable is taught along the portion passing over the cable guide (with or without a load present). In this way, the pulley absorbs or removes, to a certain extent, the slack present in the cable 13. Although shown with only a single biased guide pulley, it will be appreciated that multiple pulleys may be employed, or a longer travel length provided in order to provide the lift with the ability to absorb additional slack.

On the side of bracket 22, as depicted in FIG. 3, is a slack switch 60 that is designed to detect whenever the axel 26 of the guide pulley has been drawn by springs 54 from its lowest position—meaning that the cable has been allowed to go slack. In one embodiment, switch 60 is a nominally "open" switch, and it is held in a to "closed" state so long as axel 26 causes associated glide plate 28 to remain in contact with the switch. If not in contact, or if the switch fails, an "open" circuit will be detected by the controller to which the switch is attached and the appropriate action will be taken. Thus, the output of switch 60 is sensed by the controller of the G-Force lift (not shown) to stop operation of the G-Force actuator 12 and prevent the cable from being wound or unwound until the slack condition that has been detected is resolved—again indicated by the switch 60 detecting the presence of the guide plate associated with the guide pulley. It will be appreciated that various switch/sensing mechanisms may be employed to detect the position of the cable guide pulley axel and generate signals indicating changes in the position. For example, although shown with an electromechanical, micro-switch, the position may also be detected with alternative electromechanical switches or possibly optical devices.

As illustrated In FIGS. 1-3, the guide plate is designed to move, in conjunction with the cable guide pulley axel 26, along the elongated aperture 48. The movement is intended to allow the guide pulley to "dampen" or absorb slack that may be created in the cable, in addition to detecting the cable slack as described above. Accordingly, the combination of the switch and spring-loaded cable guide allows not only the detection, but the reduction of cable slack in the event that the end-effector is prevented from moving downward while the actuator continues to unwind the cable.

Having described one aspect of the present invention, attention is now turned to another safety and control aspect. On the opposite side of bracket 22 is a lower limit switch 70 that is designed to sense or detect the position of the groove follower 40 when it has reached a predetermined position. In particular, the switch 70 is positioned in such a way as to detect when the groove-follower has moved to a position where approximately two "winds" of the cable 13 remain on the lift pulley 20, thereby assuring a safe operating condition. In operation, the groove follower 40 and associated cable guide pulley 24, move laterally (arrow 23) as the rope or cable 13 is wound and unwound from the drive pulley 11. Upon reaching the outer-most extreme position as seen in FIGS. 1 and 2, as cable is unwound from the pulley 11, the bracket 42 connecting the groove follower and guide pulley comes into contact with limit switch 70. This causes switch 70 to "open" resulting in a signal to the controller to stop the actuator and prevent further unwinding of the cable. Once the switch is made, the actuator will not further unwind. It will be appreciated that that switch 70 may be used, not only to prevent unwinding of the cable to less than two winds on the pulley 11, but may also be used as a lower limit or stop for the lift cable. Accordingly, it is contemplated that the position and mounting assembly 72 for switch 70 may be adjustable in a lateral direction so as to cause the switch to be actuated when the end effector is at a particular height relative to the actuator (e.g., a work table height), preferably maintaining at least two complete winds of the cable on pulley 11.

In an embodiment of the present invention, the switches are used to provide signals to the controller which then prevents further operation of the actuator and winding/unwinding of the cable from lift pulley 20. It will be appreciated, however, that the switches may also be used as failsafe or emergency stops where, in addition to passing signals to the controller, they may be used to energize a brake or other mechanism by which the further operation of the actuator or rotation of the lift pulley may be prevented until the condition is cleared.

Figure 5:
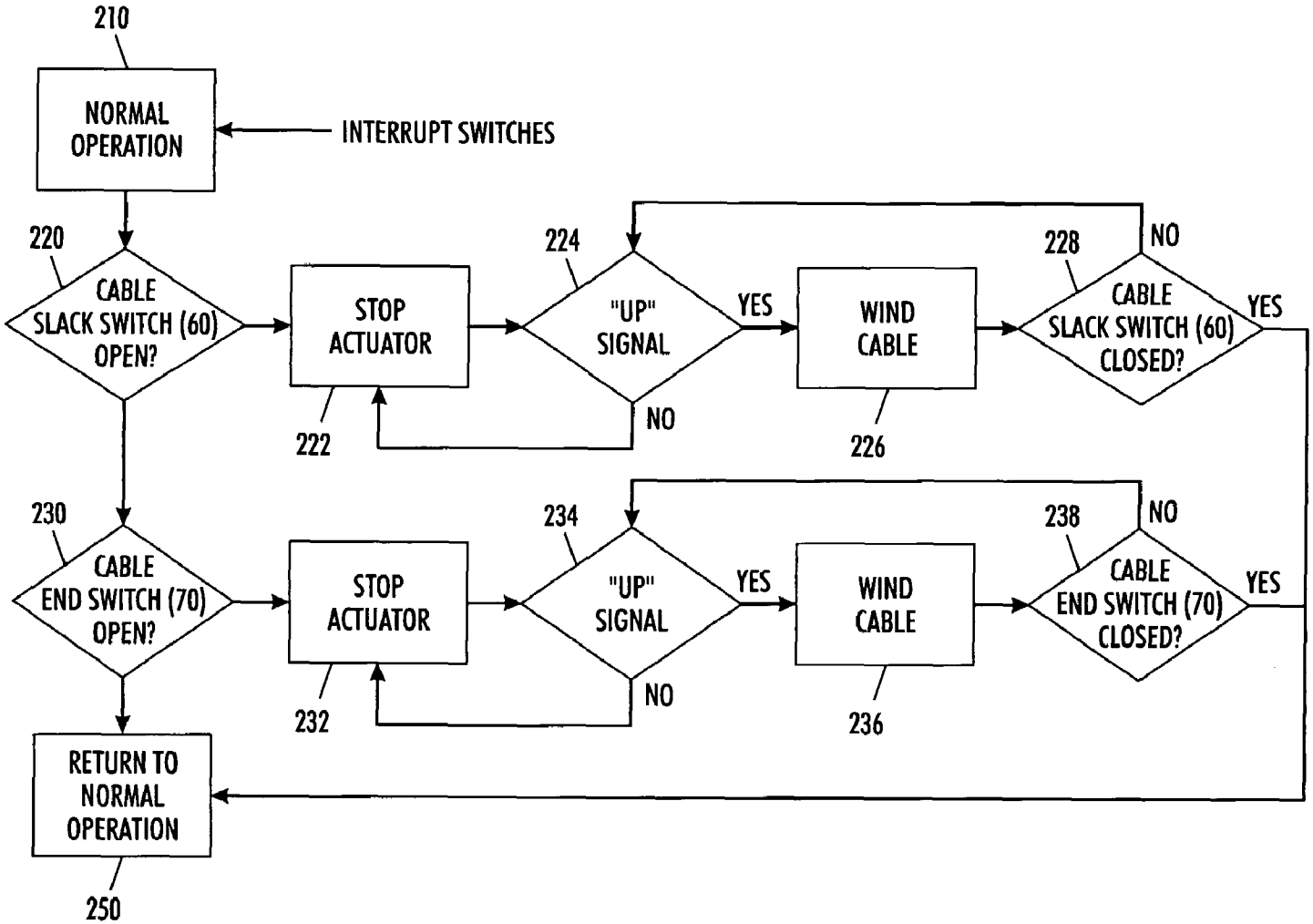
FIG. 5 is a flowchart of the operation of an embodiment of the present invention.

Turning now to FIG. 5, depicted therein is an exemplary flowchart illustrating the operation of the lift in response to the detection of the end of cable or cable slack switches (70, 60, respectively), shown as an interrupt. The flowchart is a general representation of a computer program that can be used in controller 100. Although not shown, it will be understood that the control program initializes all input and output hardware in the system before enabling operation. This includes analog-to-digital, digital-to-analog and quadrature counters in addition to any other peripherals in the controller. After calculation of all constants needed in the controller, the controller disengages the frictional brake on the actuator and will energize a green light on the controller indicating that the system is ready to be operated (normal operation step 210), where it enters the main control loop; reading actuator position, human force applied to the end-effector handle, current in the actuator, and the dead-man switch. The software then implements a transfer function on the signal representing the human force and determines if the human force is downward or upward, and directing the actuator to rotate and unwind or wind the cable accordingly.

In response to an interrupt or similar signal generated from the cable slack switch 60 or cable end switch 70, the controller carries on an associated interrogation of the switches. In particular, the state of switch 60 is first analyzed at step 220, where an "open" or actuated switch 60 will cause the program to initiate step 222, where the actuator is stopped. This step may also include engaging an electric or similar braking mechanism to prevent further unwinding of the rope or cable from the pulley. Once the actuator has been stopped, the system waits for an operator-applied upward force on handle 16 of the end-effector, step 224, before the cable is wound by the actuator at step 226. Once the cable slack switch has returned to its normal operating state, detected at step 228 as a "closed" switch, it then allows the system to return to normal operation. As will be appreciated, if the cable slack is not yet made up, the system will not permit any signal other than an "up" or raise signal to be carried out by the actuator, and the switch must remain "closed" before the system is returned to its normal operation state at step 250.

In a similar manner, steps 230-238 operate to prevent the lift pulley from unwinding the cable beyond a safe point. In this leg of the flowchart, steps 230 and 238 operate to determine the state of the cable end switch 70, where the condition of the switch allows only upward movement of the cable unless and until the switch is returned to its normal operating position (indicated as "closed"). In certain circumstances, it may be that both switches 60 and 70 are "opened" (e.g., slack at the end of travel of the cable) and it should be understood that the system would require that both switches return to their normal operating position before the system returns to normal operation. It will be further appreciated that various control schemes may be employed to detect and carry out the steps described, and although depicted in a simple flowchart, the order of the steps or the overall process may be modified while accomplishing the same functionality. Accordingly, the present invention is not intended to be limited by the exemplary embodiment depicted.

In recapitulation, the present invention is a method and apparatus for monitoring the condition of a cable in a human power amplifying lift system. The method and apparatus employ a cable slack sensor and a cable end sensor to override and prevent the lift from continuing to unwind the lift cable when slack or and end of travel limit has been reached.

It is, therefore, apparent that there has been provided, in accordance with the present invention, a method and apparatus for monitoring the condition of a cable in a human power amplifying lift system. While this invention has been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A human power amplifier assist device, including:

a lift pulley with a cable wound thereon;

an actuator arranged to turn the lift pulley so as to wind and unwind the cable;

an end-effector connected to the cable and connectable to a load, the end-effector including a sensor for detecting an operator-applied force on the end effector;

a controller for controlling operation of the actuator, the controller being responsive to a first signal from the sensor representing operator-applied force and a cable slack signal representing a slack condition of the cable; and the controller being programmed to cause the actuator to wind and unwind the cable in response to the first signal, and to override the control as a function of the first signal in response to the cable slack signal.

2. The device of claim 1, further including:

a cable slack sensor for generating the cable slack signal; and a cable end sensor for generating a cable end signal;

wherein the controller also overrides the control in response to the cable end signal.

3. The device of claim 2, wherein the lift pulley includes a continuous groove about at least a portion of the periphery thereof and where said cable end sensor includes:

a guide pulley, located between the lift pulley and the end-effector, and over which the cable passes;

a lift pulley groove follower, said follower moving in a direction parallel to the lift pulley axis in response to rotation of the lift pulley; and a cable end switch, for detecting when the pulley has unwound a predefined length of cable therefrom.

4. The device of claim 2, wherein said cable slack sensor includes:

a guide pulley, located between the lift pulley and the end-effector, and over which the cable passes;

a biasing means for biasing the guide pulley against a cable normal force caused by a cable passing thereover, said biasing means operating to absorb at least a portion of any slack in the cable; and a cable slack switch, for detecting when the pulley has moved away from a normal operating position in response to the biasing means.

5. The device of claim 2, wherein the lift pulley includes a continuous groove about at least a portion of the periphery thereof and where said cable end sensor includes:

a guide pulley, located between the lift pulley and the end-effector, and over which the cable passes;

a lift pulley groove follower, said follower moving in a direction parallel to the lift pulley axis in response to rotation of the lift pulley so as to move the guide pulley in association with the cable being unwound from the pulley; and a cable end switch, for detecting when the pulley has unwound a predefined length of cable therefrom.

6. The device of claim 1, further including a cable slack sensor for generating the cable slack signal, wherein said cable slack sensor includes:

a guide pulley, located between the lift pulley and the end-effector, and over which the cable passes;

a biasing means for biasing the guide pulley against a cable normal force caused by a cable passing thereover, said biasing means operating to absorb at least a portion of any slack in the cable; and a cable slack switch, for detecting when the pulley has moved away from a normal operating position in response to the biasing means.

7. The device of claim 6, wherein the lift pulley includes a continuous groove about at least a portion of the periphery thereof and where said cable end sensor includes:

a guide pulley, located between the lift pulley and the end-effector, and over which the cable passes;

a lift pulley groove follower, said follower moving in a direction parallel to the lift pulley axis in response to rotation of the lift pulley; and a cable end switch, for detecting when the pulley has unwound a predefined length of cable therefrom.

8. The device of claim 1, further including:

a handle on said end-effector, wherein said handle moves in response to force exerted thereon by a user, and where movement of the handle causes the generation of the first signal.

9. A device for monitoring the condition of a line wound on a lift pulley, and generating at least one signal indicative of the condition, including:

a slack sensor, operatively associated with the lift pulley for sensing slack in the line; and an end sensor, also operatively associated with the lift pulley for sensing a limit of the line;

wherein the at least one signal representing the condition of the line includes a slack signal generated by the slack sensor and an end signal generated by the end sensor.

10. The device of claim 9, wherein said slack sensor includes:

a guide pulley, located between the lift pulley and an end-effector, and over which the line passes;

a biasing means for biasing the guide pulley against a normal force caused by the line passing thereover, said biasing means operating to absorb at least a portion of any slack in the line; and a slack switch, for detecting when the pulley has moved away from a normal operating position in response to the biasing means.

11. The device of claim 9, wherein the lift pulley includes a continuous groove about at least a portion of the periphery thereof and where said end sensor includes:

a guide pulley, located between the lift pulley and the end-effector, and over which the line passes;

a lift pulley groove follower, said follower moving in a direction parallel to the lift pulley axis in response to rotation of the lift pulley; and an end switch, operatively contacting the groove follower, for detecting when the pulley has unwound a predefined length of line therefrom.

12. A method for monitoring the condition of a line wound on a lift pulley, including:

monitoring the slack condition of the line with a slack sensor; and monitoring the length of line, with an end sensor, to determine when a predetermined maximum length of line has been unwound.

13. The method of claim 12, further including generating at least one signal representing the condition of the line, wherein the at least one signal includes a slack signal generated by the slack sensor and an end signal generated by the end sensor.

14. The method of claim 12, further comprising:

biasing a guide pulley, positioned along a path of the line, against a normal force of the line caused when the line is taught, said biasing being of a sufficient magnitude so as to absorb at least a portion of the slack when the line is not taught; and detecting, using a slack switch, when the guide pulley has been moved from a normal operating position.

15. The method of claim 12, further comprising:

tracking the length of line unwound from the guide pulley using a groove follower displaced as a function of the rotation of the lift pulley; and detecting, using an end switch, when the groove follower has reached a predetermined position indicative of the maximum length of line to be unwound.

* * * * *